US009863602B2

(12) United States Patent
Hiki

(10) Patent No.: US 9,863,602 B2
(45) Date of Patent: Jan. 9, 2018

(54) LED LIGHT SOURCE DEVICE

(71) Applicant: Stanley Electric Co., Ltd., Tokyo (JP)

(72) Inventor: Satoru Hiki, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 193 days.

(21) Appl. No.: 14/858,859

(22) Filed: Sep. 18, 2015

(65) Prior Publication Data

US 2016/0091174 A1 Mar. 31, 2016

(30) Foreign Application Priority Data

Sep. 25, 2014 (JP) ..... 2014-195170

(51) Int. Cl.
*F21V 7/09* (2006.01)
*F21V 7/00* (2006.01)
(Continued)

(52) U.S. Cl.
CPC ..... *F21V 7/09* (2013.01); *F21K 9/23* (2016.08); *F21S 48/1154* (2013.01);
(Continued)

(58) Field of Classification Search
CPC ..... F21V 7/09; F21V 7/0008; F21V 7/0033; F21V 7/07; F21K 9/23; F21S 48/1154; F21S 48/137; F21S 48/1388; F21S 48/215; F21S 48/234; F21S 48/328; F21Y 2115/10
See application file for complete search history.

(56) References Cited

U.S. PATENT DOCUMENTS 6,558,032 B2 * 5/2003 Kondo ..... F21S 48/1388 362/303
2002/0191395 A1 * 12/2002 Fleury ..... F21V 13/12 362/236
(Continued)

FOREIGN PATENT DOCUMENTS

DE 10 2012 202 949 A1 8/2013
EP 1 182 395 A2 2/2002
(Continued)

OTHER PUBLICATIONS

European Search Report for related European Patent Application No. 15186649 dated Nov. 20, 2015.

*Primary Examiner* — Bao Q Truong
(74) *Attorney, Agent, or Firm* — Kenealy Vaidya LLP

(57) ABSTRACT

An LED light source device having an LED including an LED element as a light emission source and capable of possessing the same light distribution characteristics and luminance distribution as those of a common bulb having a coiled filament as a light emission source is provided. The LED light source device is also capable of providing the same light distribution pattern when it is used for a lighting fixture that utilizes a bulb as a light source, in place of a bulb. LEDs are disposed with respect to first light reflecting surfaces of paired hyperbolic cylindrical surfaces with a common focal line while LED elements of the LEDs are disposed at or near respective positions on the focal lines of the other hyperbolic cylindrical surfaces corresponding to the paired hyperbolic cylindrical surfaces.

16 Claims, 10 Drawing Sheets

(51) Int. Cl.

| | |
|---|---|
| ***F21V 7/07*** | (2006.01) |
| ***F21K 9/23*** | (2016.01) |
| ***F21S 8/10*** | (2006.01) |
| *F21Y 115/10* | (2016.01) |

(52) U.S. Cl.
CPC ..... *F21S 48/137* (2013.01); *F21S 48/1388* (2013.01); *F21S 48/215* (2013.01); *F21S 48/234* (2013.01); *F21S 48/328* (2013.01); *F21V 7/0008* (2013.01); *F21V 7/0033* (2013.01); *F21V 7/07* (2013.01); *F21Y 2115/10* (2016.08)

(56) References Cited

U.S. PATENT DOCUMENTS

| | | | | |
|---|---|---|---|---|
| 2006/0077667 | A1* | 4/2006 | Lui | F21V 5/006 362/300 |
| 2012/0140481 | A1* | 6/2012 | Simchak | F21V 7/07 362/296.07 |
| 2013/0200407 | A1* | 8/2013 | Roth | F21V 7/0016 257/91 |
| 2013/0215633 | A1 | 8/2013 | Wuerthele et al. | |

FOREIGN PATENT DOCUMENTS

| | | | |
|---|---|---|---|
| JP | 2000-315406 | A | 11/2000 |
| JP | 2000-331508 | A | 11/2000 |
| JP | 2002-157904 | A | 5/2002 |
| JP | 2007-234407 | A | 9/2007 |
| JP | 4689762 | B1 | 5/2011 |
| WO | 2013/182966 | A1 | 12/2013 |

* cited by examiner

LED LIGHT SOURCE DEVICE

This application claims the priority benefit under 35 U.S.C. §119 of Japanese Patent Application No. 2014-195170 filed on Sep. 25, 2014, which is hereby incorporated in its entirety by reference.

TECHNICAL FIELD

The presently disclosed subject matter relates to LED light source devices and lighting fixtures using the same, and in particular, to an LED light source device having an LED including an LED element as a light emission source and capable of possessing the same light distribution characteristics and luminance distribution as those of a common bulb having a coiled filament as a light emission source. The LED light source device is also capable of providing the same light distribution pattern when it is used for a lighting fixture that utilizes a bulb as a light source, in place of a bulb. Also, the presently disclosed subject matter relates to a lighting fixture using the LED light source device.

BACKGROUND ART

Japanese Patent No. 4689762 discloses an LED bulb as conventional LED light source devices of this type, which can include an optical system as illustrated in FIG. 1A.

The disclosed LED bulb can include an LED light emitting element 100 and a reflecting member 101 disposed forward of the LED light emitting element 100 in its light illumination direction. The reflecting member 101 can include a reflecting surface 105 facing to the light emission surface 102 of the LED light emitting element 100 and having a center axis 106. The reflecting surface 105 can be composed of an apex 103 projecting toward the light emission surface 102 of the LED light emitting element 100, and a curved conical reflecting surface 104 that is a side surface extending from the apex 103 and concavely curved toward the center axis 106.

With this configuration, the light emitted from the LED light emitting element 100 can be radially reflected sideward and obliquely rearward with respect to the light illumination direction by means of the curved conical reflecting surface 104 of the reflecting member 101. Then the curved conical reflecting surface 104 can form a pseud light source (E) by the reflected light (F) therefrom. According to the conventional light source device disclosed in the conventional art, the light emission direction of light from the pseud light source (E) can be substantially the same as the light emission direction of light from a halogen bulb with a filament. Consequently, the formed position and the size of the light emission region of the pseud light source (E) can be the same as those of such a halogen bulb.

In the LED bulb disclosed in Japanese Patent No. 4689762, the light from the pseud light source (E) can be reflected by the curved conical reflecting surface 104, so that the reflected light (D) can form the light distribution pattern 107 as illustrated in FIG. 1B with a curved conical shape projected by the curved conical reflecting surface 104. The light emitted from the pseud light source (E) can form distribution light characteristics and luminance distribution different from those of light emitted from a coiled filament with a constant diameter.

In other words, the light distribution characteristics of the pseud light source (E) can correspond to those of a coiled filament (F) that is prepared by winding filament while gradually changing the winding diameter to form a curved conical shape. Therefore, the pseud light source (E) can emit light rays including first light rays emitted from first portions corresponding to those of filament wound with larger diameters and second light rays emitted from second portions corresponding to those of filament wound with smaller diameters. When such a pseud light source (E) is mounted within a lighting fixture having a light distribution control system, the first light rays from the first portions of the pseud light source (E) can be controlled in light distribution characteristics in such a manner that they are spread by the light distribution control system while the second light rays from the second portions thereof can be controlled in light distribution characteristics in such a manner that they are converged to a certain direction.

As a result, the lighting fixture with such a pseud light source (E) installed therein is difficult to obtain the same or similar light distribution characteristics and illuminance distribution as or to those of a conventional lighting fixture including a coiled filament with a constant diameter. In short, even if a bulb is replaced with such an LED bulb, the light distribution characteristics of such a lighting fixture are remarkably different from those of a lighting fixture with a conventional bulb.

Furthermore, the reflecting member 101 having the curved conical reflecting surface 104 that can provide such a pseud light source (E) needs to be supported by a columnar support, and such a columnar support must be arranged in the vicinity of the reflecting member 101 due to the limited space within the lighting fixture. This, however, results in formation of a shadow by the columnar support shielding the light emitted from the pseud light source (E).

SUMMARY

The presently disclosed subject matter was devised in view of these and other problems and features in association with the conventional art. According to an aspect of the presently disclosed subject matter, an LED light source can employ an LED including an LED element as a light emission source and is capable of possessing the same or similar light distribution characteristics and luminance distribution as or to those of a common electric bulb having a coiled filament as a light emission source. The LED light source device is also capable of providing the same light distribution pattern when it is used for a lighting fixture that utilizes a bulb as a light source, in place of a bulb.

According to another aspect of the presently disclosed subject matter, an LED light source device can include: an LED including an LED element as a light emission source; and a light reflecting body configured to include a light reflecting surface configured to reflect light emitted from the LED in a predetermined direction. The light reflecting surface can include at least a first light reflecting surface composed of a first hyperbolic cylindrical surface. The first hyperbolic cylindrical surface can have an inner focal line inside the light reflecting body and be obtained by moving part of a hyperbolic line in a perpendicular direction to a plane including the hyperbolic line, the hyperbolic line having an outer focal point at or near a position at which the LED element is located.

According to another aspect of the presently disclosed subject matter, the LED light source device according to the above-described aspect can be configured such that the first light reflecting surface can further include a second hyperbolic cylindrical surface. The second hyperbolic cylindrical surface can have an inner focal line located at the inner focal line of the first hyperbolic cylindrical surface and be obtained by moving part of a hyperbolic line in a perpendicular direction to a plane including the hyperbolic line, the hyperbolic line having an outer focal point at a position different from the outer focal point of the hyperbolic line of the first hyperbolic cylindrical surface.

According to still another aspect of the presently disclosed subject matter, the LED light source device according to the above-described aspect can be configured such that the LED can comprise at least a first LED and a second LED, and the first LED can be located at or near an outer focal line obtained by moving the outer focal point of the hyperbolic line of the first hyperbolic cylindrical surface and the second LED can be located at or near an outer focal line obtained by moving the outer focal point of the hyperbolic line the second hyperbolic cylindrical surface.

According to still another aspect of the presently disclosed subject matter, the LED light source device according to any one of the above-described aspects can be configured such that the light reflecting surface can further include a second light reflecting surface. The second light reflecting surface can be configured by a free curved surface provided so as to protrude in a direction substantially perpendicular to an optical axis of the LED element and away from the LED farther than the first light reflecting surface. In this LED light source, light rays emitted from the LED element within a predetermined emission angular range around the optical axis can be incident on the first light reflecting surface and light rays emitted from the LED element by a larger angle than the predetermined emission angular range can be incident on the second light reflecting surface.

According to still another aspect of the presently disclosed subject matter, the LED light source device according to any one of the above-described aspects can be configured such that the LED can be produced by resin-sealing an LED element with a translucent resin so as to have an aspheric light emission surface. The light rays emitted from the LED element to enter the translucent resin can be refracted by the light emission surface of the translucent resin by means of lens effects to be bent toward the optical axis of the LED element when exiting the translucent resin.

Furthermore, according to still another aspect of the presently disclosed subject matter, a lighting fixture can include a reflector having a lighting chamber, an outer lens made of a transparent resin and configured to cover the reflector to define the lighting chamber, and the LED light source device according to any one of the above-described aspects, the LED light source device disposed in the lighting chamber.

As described above, the LED light source device of the presently disclosed subject matter can include the LED having the LED element as a light emission source and a light reflecting body configured to include the first and second light reflecting surfaces that are configured to reflect the light rays emitted from the LED element to predetermined directions. Further, the first light reflecting surface can be formed from a hyperbolic cylindrical surface with an outer focal line, at a certain point of which the LED can be located while the LED can be disposed to face the first light reflecting surface.

With the above-described configuration, the light rays emitted from the LED and incident on the first light reflecting surface can be reflected to an extending direction of a line connecting the incident point of the first light reflecting surface of the hyperbolic cylindrical surface and a point of an inner focal line of a hyperbolic line passing the incident point and the hyperbolic cylindrical surface. Accordingly, when the LED is assumed to be disposed above the light reflecting body and emit light rays downward, the reflected light rays can be irradiated toward a directional range of from sideward and obliquely upward direction to sideward and obliquely downward direction with respect to the first light reflecting surface, as if the reflected light rays are emitted from an apparent light source (pseud light source) disposed on a point of the inner focal line. This means that the light rays can be directed in substantially the same directions as the optical paths of light rays emitted from a coiled filament with a constant diameter (linearly extending coiled filament) and irradiated from an electric bulb toward a directional range of from sideward and obliquely upward direction to sideward and obliquely downward direction.

Therefore, the lighting fixture employing the LED light source device according to the presently disclosed subject matter can form substantially the same light distribution pattern as those obtained from a conventional lighting fixture employing an electric bulb as a light source. Therefore, even when the LED light source device of the presently disclosed subject matter is employed as a light source for a common lighting fixture in place of a common electric bulb, the same or similar light distribution characteristics and luminance distribution can be achieved without modifying the lighting fixture. Furthermore, such a common lighting fixture can employ the LED light source device simply by replacing the light source bulb of such a common lighting fixture with the LED light source device, whereby the service life of the lighting fixture can be prolonged.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to LED light source devices of the presently disclosed subject matter with reference to the accompanying drawings, FIGS. 2 to 11 in accordance with exemplary embodiments. Herein, the same or similar components will be denoted by the same reference numbers/signs.

In the description, the directions are based on the posture of a light source device in which an LED element is disposed above a light reflecting body and can emit light rays downward as illustrated in FIGS. 2, 4, 5, 6, 7, etc. unless otherwise specified.

Figures 1A, 1B:
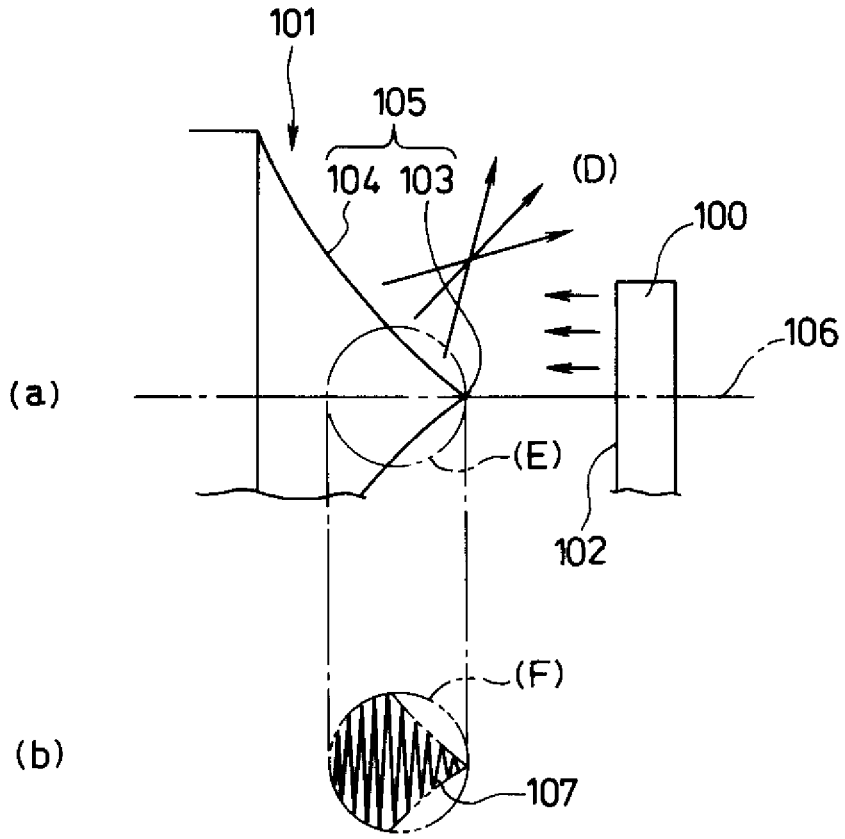
Figs. 1A and 1B Conventional Art
FIGS. 1A and 1B illustrate a conventional light source device with an LED, FIG. 1A being a partial cross-sectional view of an optical system and FIG. 1B being a schematic view illustrating a light distribution pattern of a pseud light source of the conventional light source device.
Figure 2:
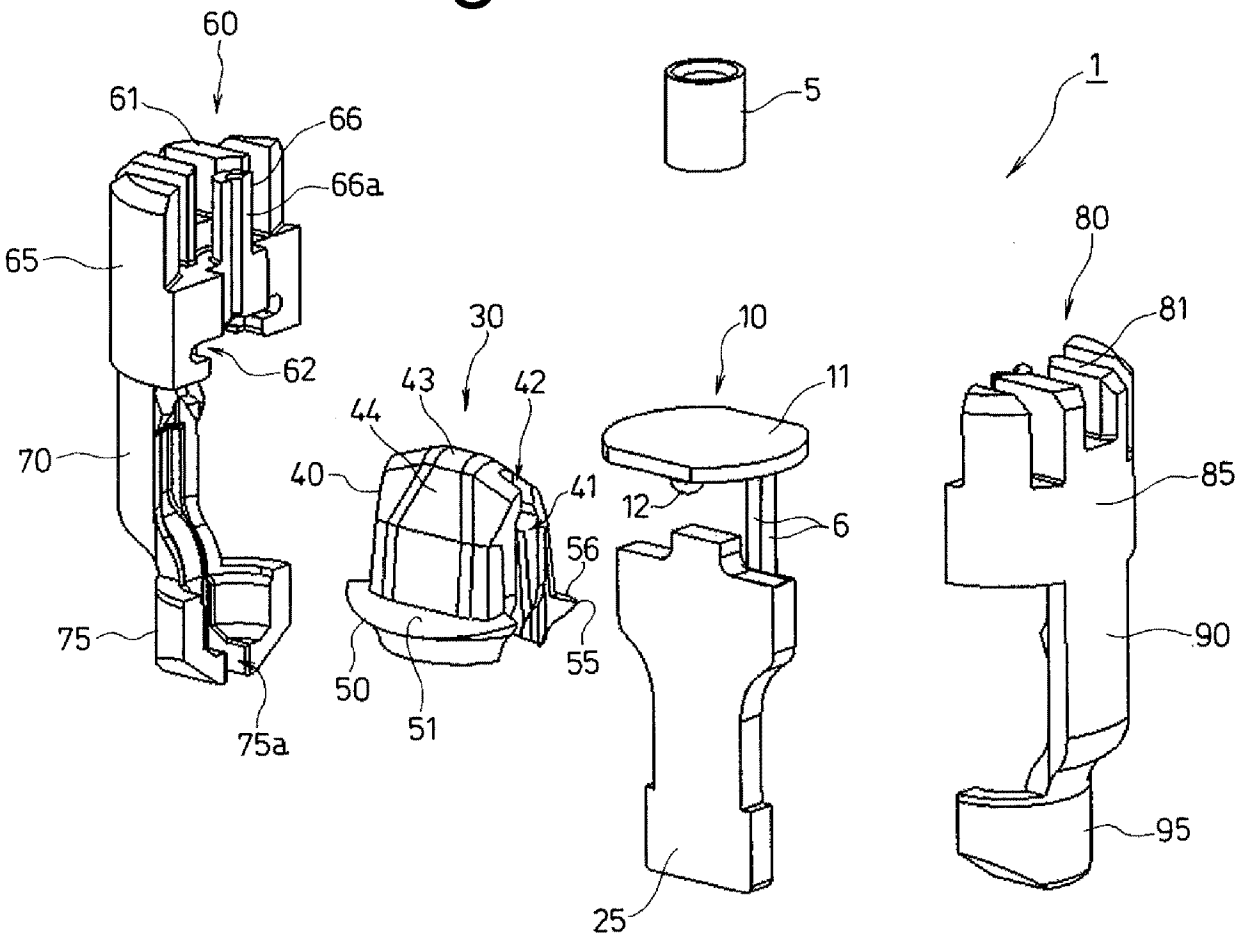
FIG. 2 is an exploded perspective view illustrating an LED light source device made in accordance with principles of the presently disclosed subject matter, as a first exemplary embodiment.
Figure 3:
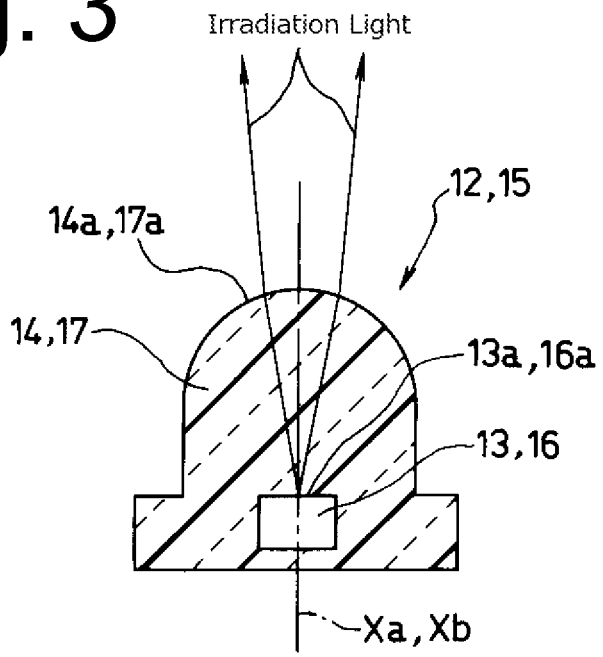
FIG. 3 is a schematic cross-sectional view illustrating an LED.
Figure 4:
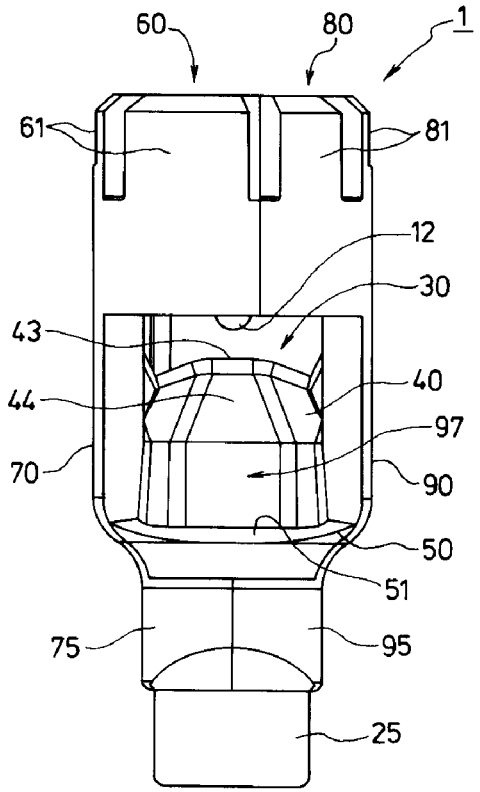
FIG. 4 is a side view of the LED light source device according to the first exemplary embodiment.
Figure 5:
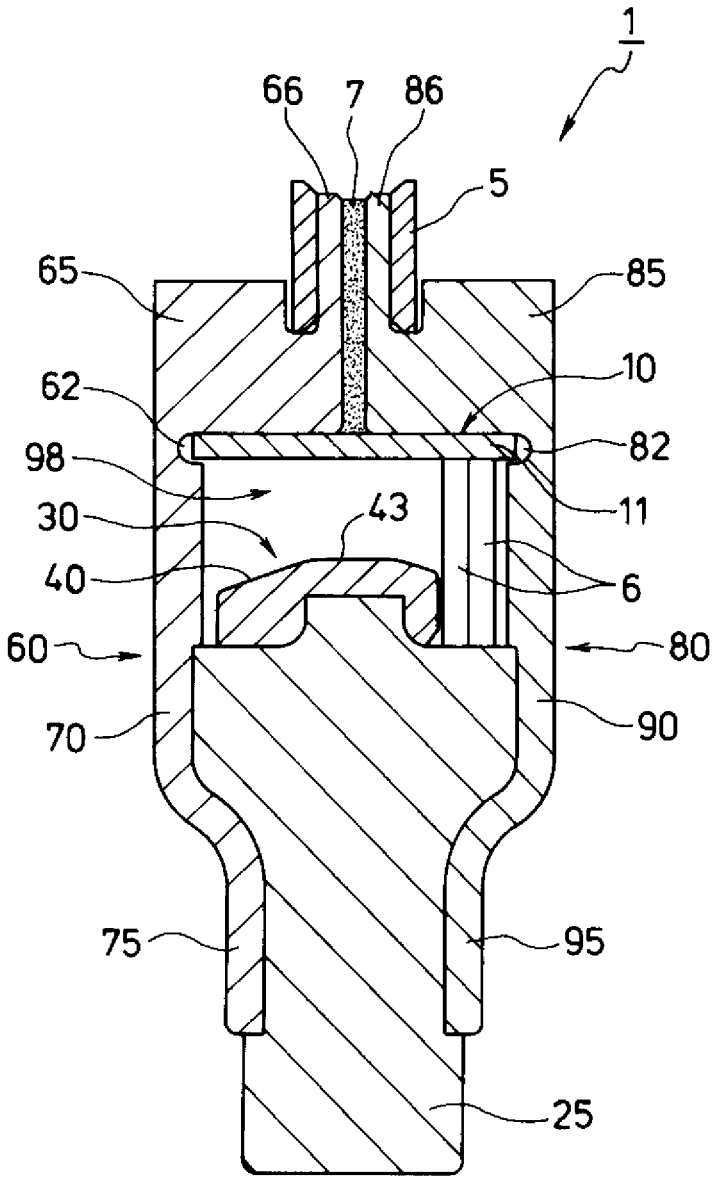
FIG. 5 is a cross-sectional view of the LED light source device according to the first exemplary embodiment when viewed from its side.
Figure 6:
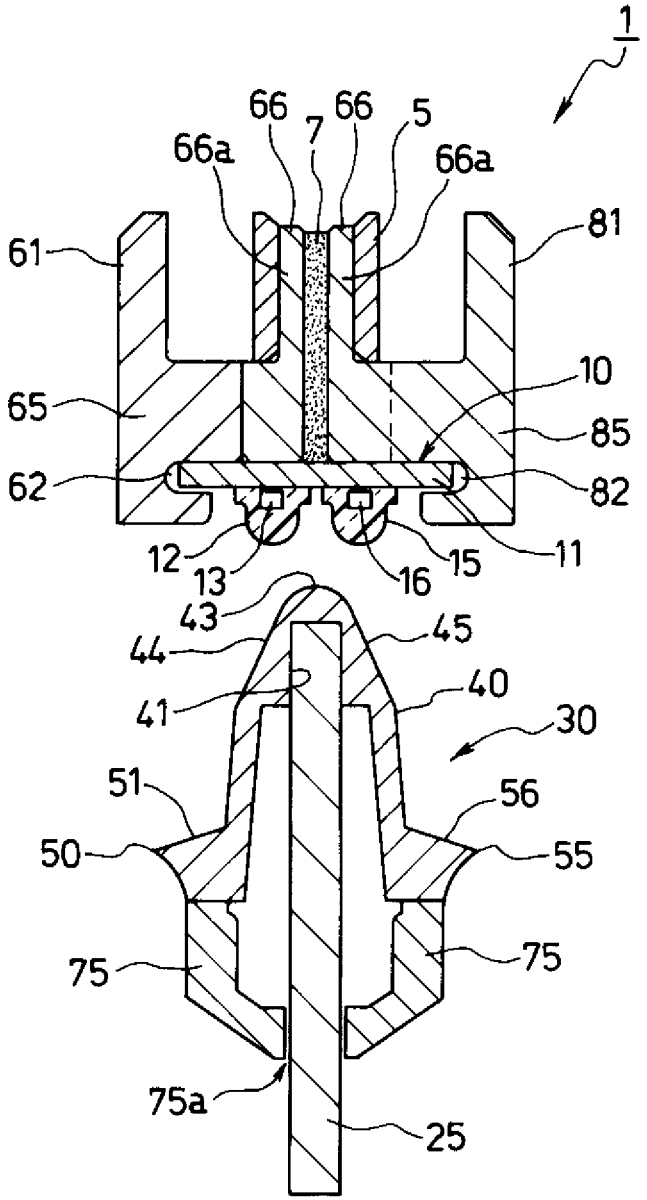
FIG. 6 is a cross-sectional view of the LED light source device according to the first exemplary embodiment when viewed from its front.

FIG. 2 is an exploded perspective view illustrating an LED light source device made in accordance with principles of the presently disclosed subject matter, as a first exemplary embodiment. FIG. 3 is a schematic cross-sectional view illustrating an LED. FIG. 4 is a side view of the LED light source device according to the first exemplary embodiment. FIG. 5 is a cross-sectional view of the LED light source device according to the first exemplary embodiment when viewed from its side. FIG. 6 is a cross-sectional view of the LED light source device according to the first exemplary embodiment when viewed from its front.

The LED light source device 1 can mainly include, as illustrated in FIG. 2: a coupling ring 5; an LED mounting board 10; a circuit board 25; a light reflecting body 30; a pair of supporting main bodies 60 and 80.

The LED mounting board 10 can include a substrate 11 on which a plurality of (in the illustrated exemplary embodiment, two) LEDs, first and second LEDs 12 and 15, are mounted. As illustrated in FIG. 3, each of the LEDs 12 and 15 can be produced by sealing an LED elements 13, 16 serving as a light emission source with a sealing resin 14, 17 composed of a translucent resin to form a light emission surface 14*a*, 17*a*. The LED elements 13, 16 can have an optical axis Xa, Xb and the light emission surface 14*a*, 17*a* can be formed as a revolved aspheric surface around the optical axis Xa, Xb as a rotational axis. With this configuration, the light rays emitted from the light emission surface 13*a*, 16*a* of the LED elements 13, 16 can enter the sealing resin 14, 17 and exit through the light emission surface 14*a*, 17*a* of the sealing resin 14, 17 while being refracted by the light emission surface 14*a*, 17*a* (lens effects) toward the optical axis Xa, Xb (in a direction that narrows the illumination range), to thereby be irradiated within a predetermined range.

With reference to FIG. 2 again, the circuit board 25 can contain not-illustrated electronic parts, not-illustrated current-limiting resistors, etc. mounted thereon. The electronic parts can include those constituting a lighting control circuit configured to control lighting of the first LED 12 and the second LED 15 on the LED mounting board 10, for example. The current-limiting resistors can be configured to limit the current passing through the first LED 12 and the second LED 15.

The light reflecting body 30 can include a dome portion 40 horizontally long at its upper portion and a pair of flange portions 50 and 55 extending along the lower edge of the dome portion 40 and outward from opposite portions of the lower edge of the dome portion 40. The dome portion 40 can have a ridge portion 43 at its top and a dome-shaped outer peripheral surface while being vertically cut at both ends in the lengthwise direction across its width, and a groove (circuit board insertion groove) 41 configured to receive and fix the circuit board 25 by fitting can be formed from at least one end side of the dome portion 40.

The outer peripheral surface of the dome portion 40 can include a composite reflecting mirror surface (hereinafter, may be referred to simply as the "composite reflecting surface") composed of a plurality of continuous reflecting mirror surfaces. In particular, as also illustrated in FIG. 6, the composite reflecting surface can include a pair of first light reflecting surfaces 44 and 45 with the ridge portion 43 interposed therebetween (on both sides thereof in the width direction) and at the center in the lengthwise direction when viewed from above. The first light reflecting surfaces 44 and 45 can be each formed from a hyperbolic cylindrical surface. Furthermore, the top surfaces of the pair of flange portions 50 and 55 can include a pair of second light reflecting surfaces 51 and 56, which can be formed from a free curved reflecting mirror surface.

Each of the pair of supporting main bodies 60 and 80 can include a heatsink portion 65, 85, a trunk portion 70, 90, and a semispherical-cup shaped base portion 75, 95. The heatsink portion 65, 85 can include a plurality of heat dissipation fins 61, 81 provided so as to radially extend, and a horizontally extending groove (LED mounting board insertion groove) 62, 82 thereinside so as to receive and support the LED mounting board 10. The trunk portions 70 and 90 extending from the corresponding heatsink portions 65 and 85 with a narrow width can hold the light reflecting body 30 and the circuit board 25 together. The semispherical-cup shaped base portion 75, 95 can be formed continuously from the corresponding trunk portion 70, 90 and have an insertion hole (circuit board insertion hole) 75*a*, 95*a* for receiving the circuit board 25 so that the one end of the circuit board 25 can extend outside of the semispherical-cup shaped base portion 75, 95. When assembling, the pair of supporting main bodies 60 and 80 can be united as a single unit while the LED mounting board 10, the circuit board 25, and the light reflecting body 30 are housed therein and supported thereby.

Furthermore, the supporting main body 60, 80 can include a semi-cylindrical coupling support 66, 86 provided so as to protrude upward at the heatsink portion 65, 85. When uniting the pair of supporting main bodies 60 and 80, while the semi-cylindrical coupling supports 66 and 86 are being mated with each other at their inner surfaces 66*a* and 86*a*, the cylindrical coupling ring 5 can surround the mated coupling supports 66 and 86. In this state, a cylinder shape can be completed by the coupling supports 66 and 86, and, as illustrated in FIGS. 5 and 6, an adhesive 7 can be filled in the space within the cylindrically combined coupling supports 66 and 86, to thereby achieve the unification.

The LED mounting board 10 and the circuit board 25 can be electrically connected to each other by lead wires 6. In order to arrange the lead wires 6, the light reflecting body 30 can be provided with a lead wire insertion groove 42 extending upward from the circuit board insertion groove 41. The electrical connection between the LED mounting board 10 and the circuit board 25 is not limited by the lead wires, but may be achieved by employing a circuit board formed from a flexible substrate or rigid substrate.

As described above, the LED light source device 1 can be constituted by the coupling ring 5, the LED mounting board 10, the circuit board 25, the light reflecting body 30, the pair of supporting main bodies 60 and 80. After assembling them, the cylindrically combined coupling supports 66 and 86 protruded from the respective heatsink portions 65 and 85 of the supporting main bodies 60 and 80 can be clamped by the cylindrical coupling ring 5, and the formed space within the cylindrically combined coupling supports 66 and 86 can be filled with the adhesive 7. In this manner, the supporting main bodies 60 and 80 can be integrally formed while the heatsink portions 65 and 85 and the base portions 75 and 95 are in close contact with each other, and the LED mounting board 10, the circuit board 25, the light reflecting body 30 can be housed within the integrated supporting main bodies 60 and 80.

In this configuration, the LED mounting board 10 can be inserted into and fit to the LED mounting board insertion grooves 62 and 82 of the heatsink portions 65 and 85, and the circuit board 25 can be inserted into and fit to the circuit board insertion groove 41 provided to the dome portion 40 of the light reflecting body 30.

In addition to this, the circuit board 25 can be interposed and held by the trunk portions 70 and 90 of the respective supporting main bodies 60 and 80, and the light reflecting body 30 can be interposed and held by the trunk portions 70 and 90 at its dome portion 40 and by the base portions 75 and 95 at its flange portions 50 and 55.

The LEDs 12 and 15 can be mounted on the lower surface of the LED mounting board 10 so that the irradiation direction thereof is directed toward the dome portion 40 of the light reflecting body 30, and can be electrically coupled with the circuit board 25 by the lead wires 6. Furthermore, the circuit board 10 at its one end can be inserted into and pass through the circuit board insertion holes 75*a* and 95*a* provided to the respective base portions 75 and 95 of the supporting main bodies 60 and 80.

Figure 7:
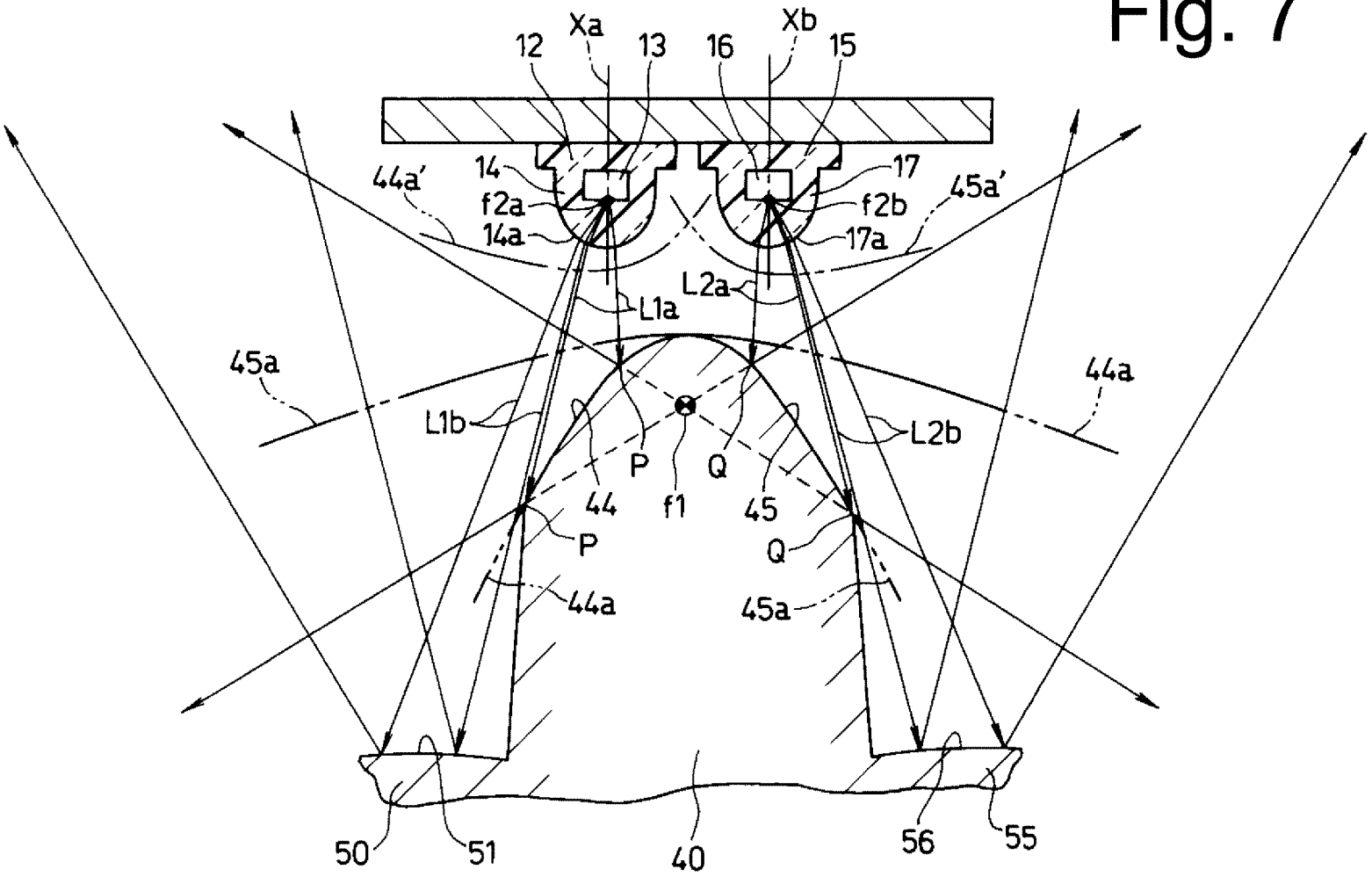
FIG. 7 is a partial enlarged cross-sectional view of the LED light source device according to the first exemplary embodiment.

A description will now be given of the optical system of the LED light source device with the above-described configuration with reference to the partial enlarged cross-sectional view of FIG. 7.

The pair of first light reflecting surfaces 44 and 45 of the dome portion 40 in the light reflecting body 30 can each be formed from a hyperbolic cylindrical surface extending in the lengthwise direction and showing a cross section 44*a*, 45*a* in the width direction being a certain hyperbolic surface. The hyperbolic cylindrical surfaces of the first light reflecting surfaces 44 and 45 can have a common inner focal line f1.

Furthermore, the first LED 12 can be disposed to face the hyperbolic cylindrical surface of the first light reflecting surface 44 having the inner focal line f1, so that the LED element 13 is positioned near or at a position which is a focal point f2*a* of a hyperbolic line 44*a*' that is paired with the hyperbolic line 44*a* (with the focal point f2*a* being located on an outer focal line paired with the inner focal line f1). In the same manner, the second LED 15 can be disposed to face the hyperbolic cylindrical surface of the first light reflecting surface 45 having the inner focal line f1, so that the LED element 16 is positioned near or at a position which is a focal point f2*b* of a hyperbolic line 45*a*' that is paired with the hyperbolic line 45*a* (with the focal point f2*b* being located on an outer focal line paired with the inner focal line f1).

With this configuration, out of light rays emitted from the LED element 13 of the first LED 12 and exiting through the light emission surface 14*a* via the sealing resin 14, light rays L1*a* directed within a predetermined emission angular range about the optical axis Xa of the LED element 13 can be incident on the first light reflecting surface 44 formed from the hyperbolic cylindrical surface having the focal line f1.

The light rays L1*a* incident on the first light reflecting surface 44 can be reflected to an extending direction of a line connecting the incident point P of the first light reflecting surface 44 and a point of the inner focal line f1. Specifically, the light rays L1*a* emitted from the light emission source at the position of focal point f2*a* and reflected by the first light reflecting surface 44 can be irradiated toward a directional range of from sideward and obliquely upward direction to sideward and obliquely downward direction with respect to the first light reflecting surface 44, as if the reflected light rays L1*a* are emitted from an apparent light source (pseud light source) disposed on a point of the inner focal line f1.

In the same manner, out of light rays emitted from the LED element 16 of the second LED 15 and exiting through the light emission surface 17*a* via the sealing resin 17, light rays L2*a* directed within a predetermined emission angular range about the optical axis Xb of the LED element 16 can be incident on the first light reflecting surface 45 formed from the hyperbolic cylindrical surface having the focal line f1.

The light rays L2*a* incident on the first light reflecting surface 45 can be reflected to an extending direction of a line connecting the incident point Q of the first light reflecting surface 45 and a point of the inner focal line f1. Specifically, the light rays L2*a* emitted from the light emission source at the position of focal point f2*b* and reflected by the first light reflecting surface 45 can be irradiated toward a directional range of from sideward and obliquely upward direction to sideward and obliquely downward direction with respect to the first light reflecting surface 45, as if the reflected light rays L2*a* are emitted from an apparent light source (pseud light source) disposed on a point of the inner focal line f1.

Furthermore, out of light rays emitted from the LED element 13 of the first LED 12 and exiting through the light emission surface 14*a* via the sealing resin 14, light rays L1*b* directed by a larger angle (larger angular range) than the predetermined emission angular range about the optical axis Xa of the LED element 13 can be incident on the second light reflecting surface 51 of the flange portion 50. Then, the light rays L1*b* incident on the second light reflecting surface 51 can be reflected to an obliquely upward direction with respect to the second light reflecting surface 51.

In the same manner, out of light rays emitted from the LED element 16 of the second LED 15 and exiting through the light emission surface 17*a* via the sealing resin 17, light rays L2*b* directed by a larger angle (larger angular range) than the predetermined emission angular range about the optical axis Xb of the LED element 16 can be incident on the second light reflecting surface 56 of the flange portion 55. Then, the light rays L2*b* incident on the second light reflecting surface 56 can be reflected to an obliquely upward direction with respect to the second light reflecting surface 56.

It should be noted that the light rays L1*a* reflected by the first light reflecting surface 44 and directed toward a directional range of from sideward and obliquely upward direction to sideward and obliquely downward direction with respect to the first light reflecting surface 44 and the light rays L1*b* reflected by the second light reflecting surface 51 and directed to an obliquely upward direction with respect to the second light reflecting surface 51 can be irradiated outward through an opening 97 formed by the integrated supporting main bodies 60 and 80. (See FIG. 4.) Furthermore, the light rays L2*a* reflected by the first light reflecting surface 45 and directed toward a directional range of from sideward and obliquely upward direction to sideward and obliquely downward direction with respect to the first light reflecting surface 45 and the light rays L2*b* reflected by the second light reflecting surface 56 and directed to an obliquely upward direction with respect to the second light reflecting surface 56 can be irradiated outward through another opening 98 formed by the integrated supporting main bodies 60 and 80.

Therefore, the light rays reflected by the first light reflecting surfaces 44 and 45 and the second light reflecting surfaces 51 and 56 can be irradiated outside of the LED light source device without being shielded, which can increase the light utilization efficiency as well as achieve the brighter LED light source device 1.

Figure 8A:
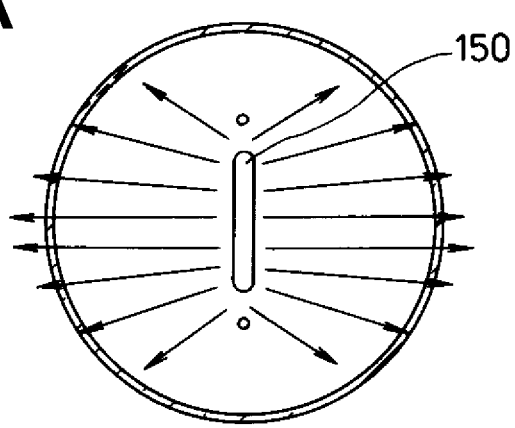
FIGS. 8A and 8B are schematic horizontal cross-sectional views of a conventional electric bulb (8A) and the LED light source device (8B) according to the first exemplary embodiment, respectively, for comparison.
Figure 8B:
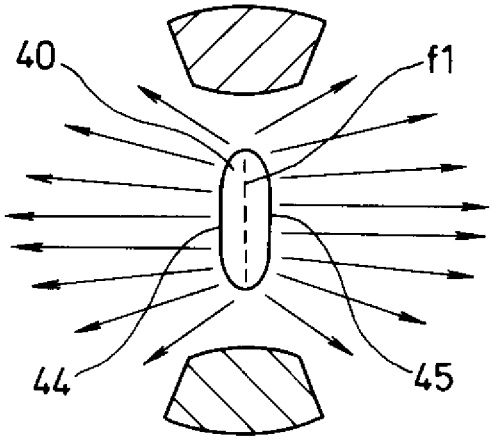

Then, the light emission direction of the exiting light rays from the LED light source device with the above configuration will be compared with the light emission direction of the exiting light rays from the linearly extended coiled filament 150. FIGS. 8A and 8B are schematic horizontal cross-sectional views of a conventional electric bulb (8A) and the LED light source device (8B) according to the first exemplary embodiment, respectively, for comparison. Specifically, FIG. 8A illustrates the light rays emitted from the filament 150 and directed both sideward directions with respect to the elongated filament 150. On the other hand, FIG. 8B illustrates the light rays emitted from the LEDs 12 and 15 and reflected both sideward directions by the first light reflecting surfaces 44 and 45 provided along the lengthwise direction of the light reflecting body 30. Specifically, the light rays can be assumed to be emitted from an apparent pseud light source disposed at a certain point on the focal line f1 within the dome portion 40 of the light reflecting body 30, and reflected by the first light reflecting surfaces 44 and 45 of a hyperbolic cylindrical surface disposed along the lengthwise direction of the light reflecting body 30. As illustrated, the light rays can be irradiated almost in the same directions as those for the conventional electric bulb.

Figure 9:
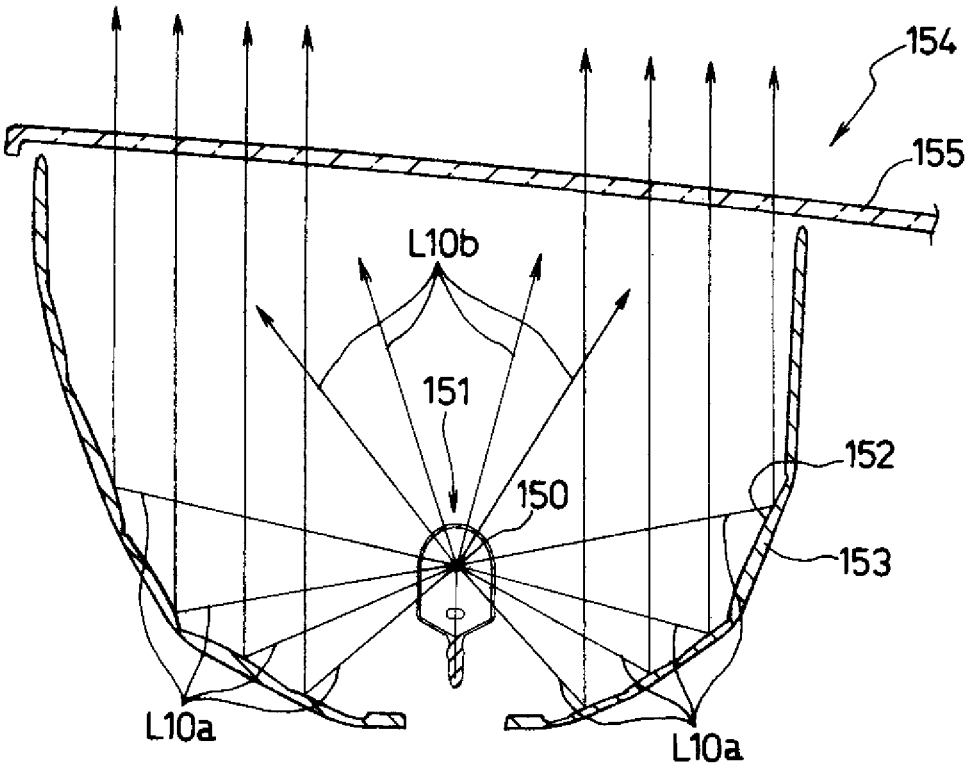
Fig. 9 Conventional Art
FIG. 9 is a schematic cross-sectional view of a conventional lighting fixture employing a conventional electric bulb.
Figure 10:
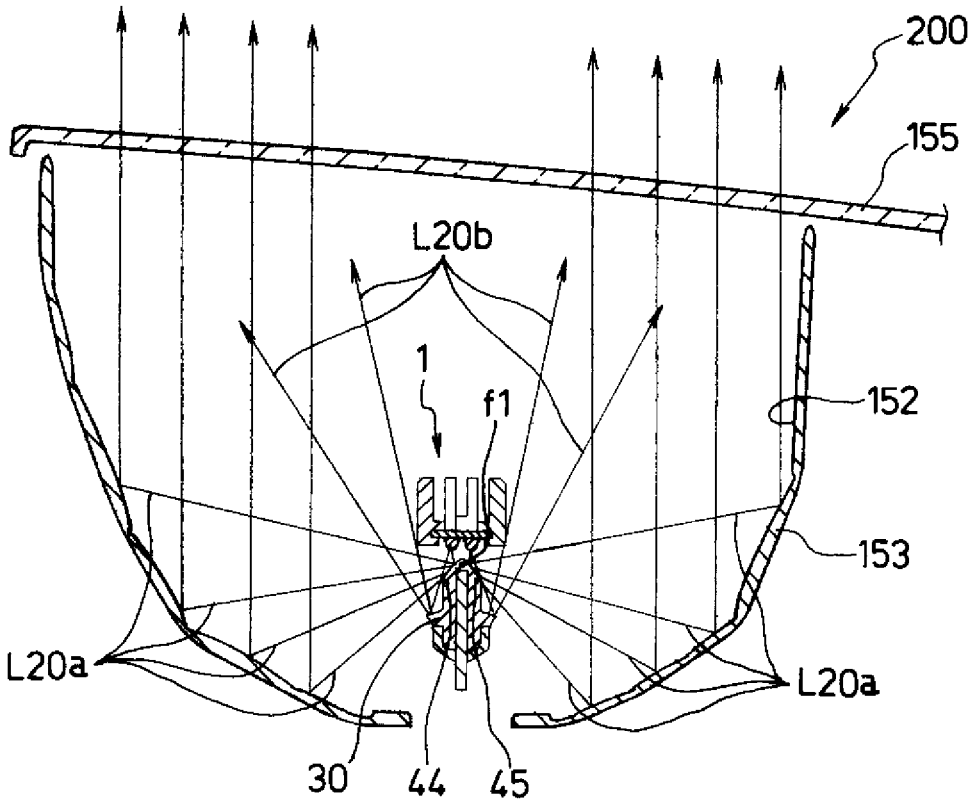
FIG. 10 is a schematic cross-sectional view of a lighting fixture employing the LED light source device according to the first exemplary embodiment.

Next, further comparison will be made between a conventional lighting fixture, as illustrated in FIG. 9, employing an electric bulb 151 with the filament 150 as a light emission source and a reflector 153 surrounding the electric bulb 151 and having a light reflecting surface 152, and a lighting fixture 200, as illustrated in FIG. 10, employing the LED light source device 1 according to the first exemplary embodiment, in which the inner focal line f1 common to the pair of first light reflecting surfaces 44 and 45 of the light reflecting body 30 is disposed at a position corresponding the filament 150 of the bulb 151. The optical paths of light rays L10*a* in the conventional lighting fixture 154 are substantially the same as the optical paths of light rays L20*a* in the lighting fixture 200 utilizing the LED light source device 1. In the conventional lighting fixture 154, the light rays L10*a* can be emitted from the filament 150 and irradiated from the electric bulb 151 to be directed toward a directional range of from sideward and obliquely upward direction to sideward and obliquely downward direction with respect to the electric bulb 151. In the lighting fixture 200, the light rays L20*a* can be emitted from the apparent pseud light source disposed at a certain point on the focal line f1 and irradiated from the LED light source device 1 to be directed toward the same or similar directional range as the conventional electric bulb 151 (of from sideward and obliquely upward direction to sideward and obliquely downward direction with respect to the LED light source device 1).

Furthermore, the optical paths of the light rays L10*b* emitted from the filament 150 and irradiated from the electric bulb 151 to be directed to obliquely upward directions with respect to the electric bulb 151 can be substantially the same as those of the light rays L20*b* emitted from the apparent pseud light source at the position of focal line f1 and irradiated from the LED light source device 1 to be directed to obliquely upward directions with respect to the LED light source device 1 due to the second light reflecting surfaces 51 and 56.

With this conventional lighting fixture 154 utilizing the electric bulb 151 as a light source, the light rays L10*a* irradiated to be directed toward the directional range of from sideward and obliquely upward direction to sideward and obliquely downward direction with respect to the electric bulb 151 and reflected by a light reflecting surface 152 of a reflector 153 and passing through a forward outer lens 155 and the light rays L10*b* irradiated to be directed to the obliquely upward directions with respect to the electric bulb 151 and directly passing through the outer lens 155 can be combined to form a light distribution pattern. On the other hand, with the lighting fixture 200 utilizing the LED light source device 1 as a light source, the light rays L20*a* irradiated to be directed toward the directional range of from sideward and obliquely upward direction to sideward and obliquely downward direction with respect to the LED light source device 1 and reflected by a light reflecting surface 152 of a reflector 153 and passing through a forward outer lens 155 and the light rays L20*b* irradiated to be directed to obliquely upward directions with respect to the LED light source device 1 and directly passing through the outer lens 155 can be combined to form a light distribution pattern. The resulting light distribution pattern formed by the lighting fixture 200 utilizing the LED light source device 1 can be almost the same as that formed by the conventional lighting fixture 154 utilizing the electric bulb 151 (filament 150).

Therefore, even when the LED light source device 1 of the presently disclosed subject matter is employed as a light source for a common lighting fixture in place of a common electric bulb, the same or similar light distribution characteristics and luminance distribution can be achieved without modifying the lighting fixture. Furthermore, such a common lighting fixture can employ the LED light source device simply by replacing the electric bulb of such a common lighting fixture with the LED light source device, whereby the service life of the lighting fixture can be prolonged.

Next, a description will be give of a comparison of the LED light source device of the presently disclosed subject matter (first exemplary embodiment) with a conventional LED bulb as disclosed in Japanese Patent No. 4689762.

As disclosed therein, the conventional LED bulb can provide an elongated oval shape as a pseud light source shape due to the curved conical reflecting surface of the reflecting member, which serves as a pseud light source by the reflected light therefrom, and thus, the shape of the pseud light source of the conventional LED bulb is absolutely different from the common filament shape (linearly extending with a constant diameter) as a light source for a common electric bulb. As a result, even if an electric bulb of a lighting fixture is replaced with the conventional LED bulb, since the light distribution pattern provided by the lighting fixture using the conventional LED bulb is different from the original one, the simple replacement cannot achieve the normal use of such a lighting fixture with the different light distribution pattern.

Furthermore, in the lighting fixture using such a conventional LED bulb, almost all the light rays emitted from the LED light emitting element are irradiated outside of the lighting fixture via two times reflection by the reflecting surface of the reflecting member and a concave reflecting mirror of the lighting fixture. This results in failure of reproduction of direct light rays from a bulb. In view of this point, the lighting fixture with the conventional LED bulb replacing the electric bulb cannot reproduce the same light distribution pattern.

On the contrary, the LED light source device of the presently disclosed subject matter can provide almost the same shape as the common filament shape (linearly extending with a constant diameter) because the shape of the pseud light source by the reflected light from the LED light source can be formed by the first light reflecting surface with a hyperbolic cylindrical surface having an extended focal line, and the pseud light source can be shaped corresponding to the shape extending along the focal line. Consequently, even when the LED light source device of the presently disclosed subject matter is employed as a light source for a common lighting fixture in place of a common electric bulb, the same or similar light distribution pattern can be formed without modifying the lighting fixture.

In addition to this feature, in the lighting fixture utilizing the LED light source device of the presently disclosed subject matter, part of the light rays emitted from the LED light source can be reflected by the second light reflecting surfaces of the light reflecting body to obliquely upward directions and irradiated outward directly. Thus, the LED light source device with this configuration can achieve the reproduction of direct light rays from a bulb. In view of this point, the LED light source device can contribute to the formation of the light distribution pattern by the lighting fixture even when a bulb is replaced with the LED light source device.

Furthermore, in the LED light source device 1, the first LED 12 can irradiate the first light reflecting surface 44 and the second light reflecting surface 51 of the light reflecting body 30 with the emission light rays therefrom while the second LED 15 can irradiate the first light reflecting surface 45 and the second light reflecting surface 56 of the light reflecting body 30 with the emission light rays therefrom. This configuration can increase the amount of light rays reflected by the respective light reflecting surfaces 44, 51, 45, and 56, thereby achieving a brighter lighting fixture.

Figure 11:
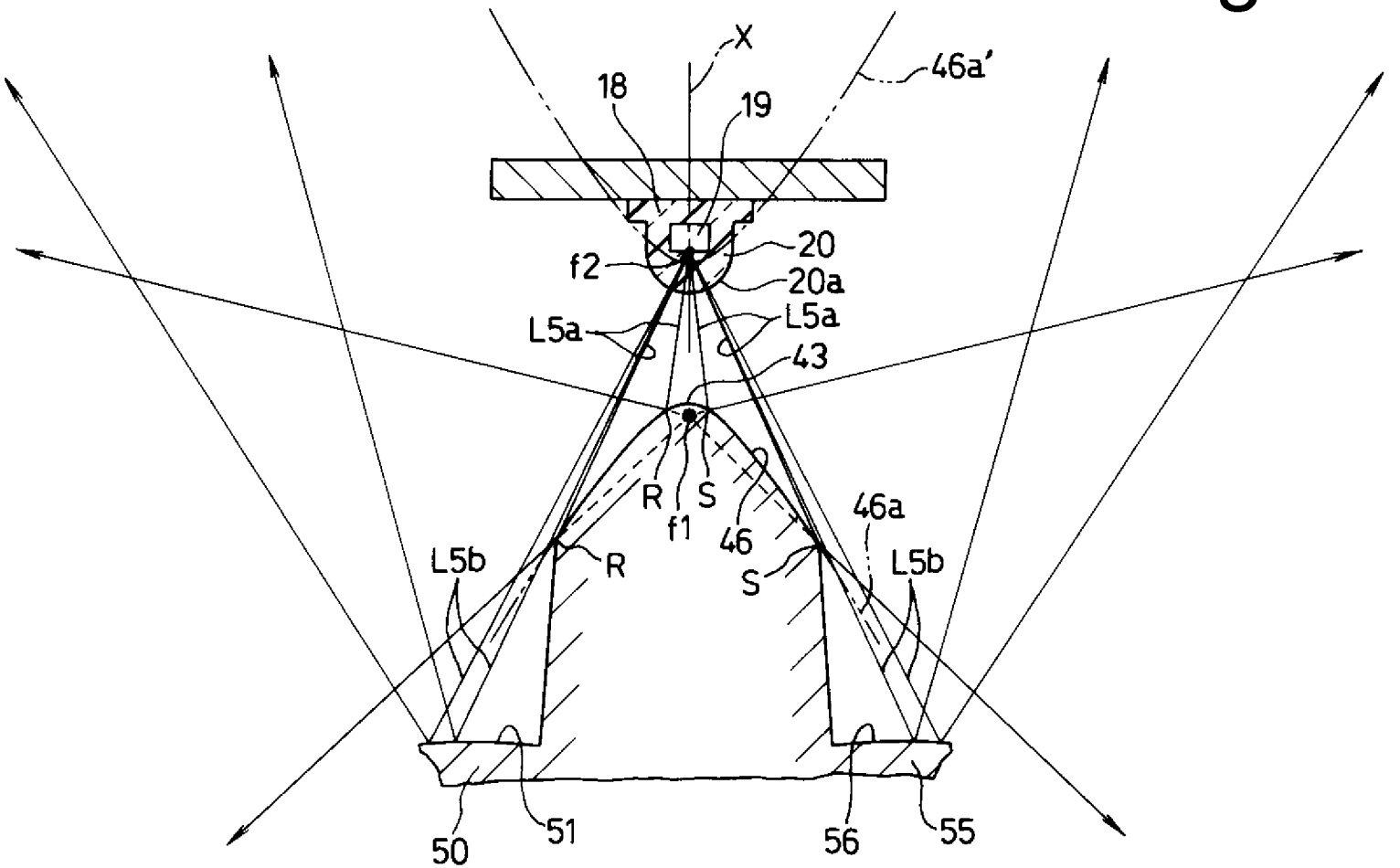
FIG. 11 is a partial enlarged cross-sectional view of an LED light source device according to a second exemplary embodiment.

Next, FIG. 11 is a partial enlarged cross-sectional view of an LED light source device according to a second exemplary embodiment, in particular, illustrating an optical system.

The second exemplary embodiment is different from the first exemplary embodiment in that the configuration of the first light reflecting surface of the light reflecting body and the positional relationship between the LED and the first light reflecting surface.

Specifically, the composite reflecting surface can include the first light reflecting surface 46 that can be formed from a hyperbolic cylindrical surface including the ridge portion 43 while being disposed at the center of the light reflecting body in the lengthwise direction when viewed from above. The hyperbolic cylindrical surface can extend in the lengthwise direction and show a cross section 46*a* in the width direction being a certain hyperbolic line.

Furthermore, an LED 18 can be disposed to face the hyperbolic cylindrical surface of the first light reflecting surface 46 having the inner focal line f1, with an LED element 19 positioned near or at a position which is a focal point f2 of a hyperbolic line 46*a*' that is paired with the hyperbolic line 46*a* (with the focal point f2 being located on an outer focal line paired with the inner focal line f1).

With this configuration, out of light rays emitted from the LED element 19 of the LED 18 and exiting through the light emission surface 20*a* via the sealing resin 20, light rays L5*a* directed within a predetermined emission angular range about and including the optical axis X of the LED element 19 can be incident on the first light reflecting surface 46 formed from the hyperbolic cylindrical surface having the focal line f1.

The light rays L5*a* incident on the first light reflecting surface 46 can be reflected by the same to an extending direction of a line connecting the incident point R of the first light reflecting surface 46 and the closest point of the inner focal line f1 to the incident point R. Specifically, the light rays L5*a* emitted from the light emission source at the position of focal point f2 and reflected by the first light reflecting surface 46 can be irradiated toward a directional range of from sideward and obliquely upward direction to sideward and obliquely downward direction with respect to the first light reflecting surface 46, as if the reflected light rays L5*a* are emitted from an apparent light source (pseud light source) disposed on a point of the inner focal line f1.

Furthermore, out of light rays emitted from the LED element 19 of the LED 18 and exiting through the light emission surface 20*a* via the sealing resin 20, light rays L5*b* directed by a larger angle (larger angular ranges with the optical axis X interposed therebetween) than the predetermined emission angular range about and including the optical axis X of the LED element 19 can be incident on the second light reflecting surfaces 51 and 56 of the flange portions 50 and 55. Then, the light rays L5*b* incident on the second light reflecting surfaces 51 and 56 can be reflected to obliquely upward directions with respect to the second light reflecting surfaces 51 and 56.

With this configuration, as in the first exemplary embodiment, the optical paths of light rays in the conventional lighting fixture are substantially the same as the optical paths of light rays in the lighting fixture utilizing the LED light source device. In the conventional lighting fixture, the light rays can be emitted from the filament (linearly extended coiled filament with a constant diameter) and irradiated from the electric bulb to be directed toward a directional range of from sideward and obliquely upward direction to sideward and obliquely downward direction with respect to the electric bulb. In the lighting fixture using the LED light source device of the presently disclosed subject matter, the light rays can be emitted from the apparent pseud light source disposed at a certain point on the focal line f1 and irradiated from the LED light source device to be directed toward the same or similar directional range as the conventional electric bulb (of from sideward and obliquely upward direction to sideward and obliquely downward direction with respect to the LED light source device).

Therefore, the resulting light distribution pattern formed by the lighting fixture utilizing the LED light source device according to the second exemplary embodiment can be almost the same as that formed by the conventional lighting fixture utilizing the electric bulb (filament). Therefore, even when the LED light source device of the presently disclosed subject matter is employed as a light source for a common lighting fixture in place of a common electric bulb, the same or similar light distribution characteristics and luminance distribution can be achieved without modifying the lighting fixture. Furthermore, such a common lighting fixture can employ the LED light source device simply by replacing the electric bulb of such a common lighting fixture with the LED light source device, whereby the service life of the lighting fixture can be prolonged.

Note that in the second exemplary embodiment, a single LED 18 can irradiate with light rays the first light reflecting surface 46 disposed on both sides in the width direction with the ridge portion 43 interposed therebetween. This configuration can reduce the number of used LED elements, thereby achieving cost reduction in manufacture of the LED light source device as well as parts cost.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. An LED light source device comprising:

an LED including an LED element as a light emission source; and a light reflecting body configured to include a light reflecting surface configured to reflect light emitted from the LED in a predetermined direction, wherein the light reflecting surface is configured to include at least a first light reflecting surface composed of a first hyperbolic cylindrical surface, the first hyperbolic cylindrical surface is configured to have an inner focal line inside the light reflecting body and be obtained by moving part of a hyperbolic line in a perpendicular direction to a plane including the hyperbolic line, the hyperbolic line having an outer focal point at or near a position at which the LED element is located, the first light reflecting surface is configured to further include a second hyperbolic cylindrical surface, and the second hyperbolic cylindrical surface is configured to have an inner focal line located at the inner focal line of the first hyperbolic cylindrical surface and be obtained by moving part of a hyperbolic line in a perpendicular direction to a plane including the hyperbolic line, the hyperbolic line having an outer focal point at a position different from the outer focal point of the hyperbolic line of the first hyperbolic cylindrical surface.

2. The LED light source device according to claim 1, wherein the LED comprises at least a first LED and a second LED; and the first LED is located at or near an outer focal line obtained by moving the outer focal point of the hyperbolic line of the first hyperbolic cylindrical surface and the second LED element is located at or near an outer focal line obtained by moving the outer focal point of the hyperbolic line of the second hyperbolic cylindrical surface.

3. The LED light source device according to claim 1, wherein:

the light reflecting surface is configured to further include a second light reflecting surface;

the second light reflecting surface is configured by a free curved surface provided so as to protrude in a direction substantially perpendicular to an optical axis of the LED element and away from the LED farther than the first light reflecting surface;

light rays emitted from the LED element within a predetermined emission angular range around the optical axis are incident on the first light reflecting surface; and light rays emitted from the LED element by a larger angle than the predetermined emission angular range are incident on the second light reflecting surface.

4. The LED light source device according to claim 2, wherein:

the light reflecting surface is configured to further include a second light reflecting surface;

the second light reflecting surface is configured by a free curved surface provided so as to protrude in a direction substantially perpendicular to an optical axis of the LED element and away from the LED farther than the first light reflecting surface;

light rays emitted from the LED element within a predetermined emission angular range around the optical axis are incident on the first light reflecting surface; and light rays emitted from the LED element by a larger angle than the predetermined emission angular range are incident on the second light reflecting surface.

5. The LED light source device according to claim 1, wherein the LED is produced by resin-sealing an LED element with a translucent resin so as to have an aspheric light emission surface; and the light rays emitted from the LED element to enter the translucent resin are refracted by the light emission surface of the translucent resin by means of lens effects to be bent toward an optical axis of the LED element when exiting the translucent resin.

6. The LED light source device according to claim 2, wherein the LED is produced by resin-sealing an LED element with a translucent resin so as to have an aspheric light emission surface; and the light rays emitted from the LED element to enter the translucent resin are refracted by the light emission surface of the translucent resin by means of lens effects to be bent toward an optical axis of the LED element when exiting the translucent resin.

7. The LED light source device according to claim 3, wherein the LED is produced by resin-sealing an LED element with a translucent resin so as to have an aspheric light emission surface; and the light rays emitted from the LED element to enter the translucent resin are refracted by the light emission surface of the translucent resin by means of lens effects to be bent toward the optical axis of the LED element when exiting the translucent resin.

8. The LED light source device according to claim 4, wherein the LED is produced by resin-sealing an LED element with a translucent resin so as to have an aspheric light emission surface; and the light rays emitted from the LED element to enter the translucent resin are refracted by the light emission surface of the translucent resin by means of lens effects to be bent toward the optical axis of the LED element when exiting the translucent resin.

9. A lighting fixture comprising:

a reflector having a lighting chamber; an outer lens made of a transparent resin and configured to cover the reflector to define the lighting chamber; and an LED light source device disposed in the lighting chamber and including: an LED including an LED element as a light emission source; and a light reflecting body configured to include a light reflecting surface configured to reflect light emitted from the LED in a predetermined direction, wherein the light reflecting surface is configured to include at least a first light reflecting surface composed of a first hyperbolic cylindrical surface, the first hyperbolic cylindrical surface is configured to have an inner focal line inside the light reflecting body and be obtained by moving part of a hyperbolic line in a perpendicular direction to a plane including the hyperbolic line, the hyperbolic line having an outer focal point at or near a position at which the LED element is located, the first light reflecting surface is configured to further include a second hyperbolic cylindrical surface, and the second hyperbolic cylindrical surface is configured to have an inner focal line located at the inner focal line of the first hyperbolic cylindrical surface and be obtained by moving part of a hyperbolic line in a perpendicular direction to a plane including the hyperbolic line, the hyperbolic line having an outer focal point at a position different from the outer focal point of the hyperbolic line of the first hyperbolic cylindrical surface.

10. The lighting fixture according to claim 9, wherein the LED comprises at least a first LED and a second LED; and the first LED is located at or near an outer focal line obtained by moving the outer focal point of the hyperbolic line of the first hyperbolic cylindrical surface and the second LED element is located at or near an outer focal line obtained by moving the outer focal point of the hyperbolic line of the second hyperbolic cylindrical surface.

11. The lighting fixture according to claim 9, wherein the light reflecting surface is configured to further include a second light reflecting surface;

the second light reflecting surface is configured by a free curved surface provided so as to protrude in a direction substantially perpendicular to an optical axis of the LED element and away from the LED farther than the first light reflecting surface;

light rays emitted from the LED element within a predetermined emission angular range around the optical axis are incident on the first light reflecting surface; and light rays emitted from the LED element by a larger angle than the predetermined emission angular range are incident on the second light reflecting surface.

12. The lighting fixture according to claim 10, wherein the light reflecting surface is configured to further include a second light reflecting surface;

the second light reflecting surface is configured by a free curved surface provided so as to protrude in a direction substantially perpendicular to an optical axis of the LED element and away from the LED farther than the first light reflecting surface;

light rays emitted from the LED element within a predetermined emission angular range around the optical axis are incident on the first light reflecting surface; and light rays emitted from the LED element by a larger angle than the predetermined emission angular range are incident on the second light reflecting surface.

13. The lighting fixture according to claim 9, wherein the LED is produced by resin-sealing an LED element with a translucent resin so as to have an aspheric light emission surface; and the light rays emitted from the LED element to enter the translucent resin are refracted by the light emission surface of the translucent resin by means of lens effects to be bent toward an optical axis of the LED element when exiting the translucent resin.

14. The lighting fixture according to claim 10, wherein the LED is produced by resin-sealing an LED element with a translucent resin so as to have an aspheric light emission surface; and the light rays emitted from the LED element to enter the translucent resin are refracted by the light emission surface of the translucent resin by means of lens effects to be bent toward an optical axis of the LED element when exiting the translucent resin.

15. The lighting fixture according to claim 11, wherein the LED is produced by resin-sealing an LED element with a translucent resin so as to have an aspheric light emission surface; and the light rays emitted from the LED element to enter the translucent resin are refracted by the light emission surface of the translucent resin by means of lens effects to be bent toward an optical axis of the LED element when exiting the translucent resin.

16. The lighting fixture according to claim 12, wherein the LED is produced by resin-sealing an LED element with a translucent resin so as to have an aspheric light emission surface; and the light rays emitted from the LED element to enter the translucent resin are refracted by the light emission surface of the translucent resin by means of lens effects to be bent toward an optical axis of the LED element when exiting the translucent resin.

* * * * *